US009022091B2

(12) United States Patent
Shives

(10) Patent No.: US 9,022,091 B2
(45) Date of Patent: May 5, 2015

(54) IMPACT WINDOW ASSEMBLY FOR OVERHEAD DOOR

(71) Applicant: Clopay Building Products Company, Inc., Mason, OH (US)

(72) Inventor: David A. Shives, Cincinnati, OH (US)

(73) Assignee: Clopay Building Products Company, Inc., Mason, OH (US)

( * ) Notice: Subject to any disclaimer, the term of this patent is extended or adjusted under 35 U.S.C. 154(b) by 121 days.

(21) Appl. No.: 13/799,265

(22) Filed: Mar. 13, 2013

(65) Prior Publication Data

US 2014/0262072 A1 Sep. 18, 2014

(51) Int. Cl.

| | |
|---|---|
| ***E05D 15/42*** | (2006.01) |
| ***E06B 3/48*** | (2006.01) |
| ***E06B 3/968*** | (2006.01) |
| *E06B 3/30* | (2006.01) |
| *E06B 3/54* | (2006.01) |
| *E06B 3/58* | (2006.01) |

(52) U.S. Cl.

CPC ..... *E06B 3/485* (2013.01); *E06B 3/305* (2013.01); *E06B 3/5436* (2013.01); *E06B 3/5878* (2013.01); *E06B 3/5892* (2013.01); *E06B 3/9682* (2013.01)

(58) Field of Classification Search

USPC ..... 52/208; 160/180, 201
IPC ..... E05D 15/242
See application file for complete search history.

(56) References Cited

U.S. PATENT DOCUMENTS

| | | | |
|---|---|---|---|
| 2,134,397 | A | 10/1938 | Clark |
| 2,242,499 | A | 5/1941 | Ainsworth |
| 2,575,255 | A | 11/1951 | Blodgett |
| 2,637,384 | A | 5/1953 | McCabe |
| 3,533,190 | A | 10/1970 | Hilfinger et al. |
| 3,760,543 | A | 9/1973 | McAllister |
| 3,903,669 | A | 9/1975 | Pease, Jr. et al. |
| 3,969,857 | A | 7/1976 | Stark |
| 4,021,967 | A | 5/1977 | Mulder et al. |
| 4,069,641 | A | 1/1978 | DeZutter |
| 4,241,556 | A | 12/1980 | Bursk |
| 4,246,731 | A | 1/1981 | Miro |
| 4,351,137 | A | 9/1982 | Enyart et al. |

(Continued)

FOREIGN PATENT DOCUMENTS

DE 2539363 A1 3/1976

*Primary Examiner* — Blair M Johnson
(74) *Attorney, Agent, or Firm* — Wood, Herron & Evans, LLP

(57) ABSTRACT

Overhead door panels are used in a variety of overhead doors styles and construction designs, each of which may be of different panel thicknesses and construction. Each of the panels includes a window opening to receive a window assembly therein. Window frame sub-assemblies are substantially interchangeable with one another and may be used in the variety of overhead door panel construction styles. Each window frame sub-assembly may include a front frame to be installed in the window opening. Glazing elements are mounted within each of the front frames and fasteners secure the glazing element to the front frame. Retainers may be juxtaposed to the back face of the door panels and coupled to one of the window frame sub-assemblies to thereby provide a window in the respective first or second overhead door panels. Advantageous features of this invention include the window frame sub-assemblies being interchangeable in a variety of overhead door panel designs irrespective of the thickness or construction of the door panel being a pan or fully insulated sandwich door construction.

16 Claims, 6 Drawing Sheets

(56) References Cited

U.S. PATENT DOCUMENTS

| | | | | | |
|---|---|---|---|---|---|
| 4,430,836 | A | | 2/1984 | McKann | |
| 4,525,961 | A | | 7/1985 | Hansen | |
| 4,550,542 | A | | 11/1985 | La See | |
| 4,567,931 | A | | 2/1986 | Wentzel | |
| 4,612,743 | A | | 9/1986 | Salzer | |
| 4,787,184 | A | * | 11/1988 | Boidron | 52/217 |
| 4,914,888 | A | | 4/1990 | Hanson | |
| 4,920,718 | A | | 5/1990 | Artwick et al. | |
| 4,947,606 | A | | 8/1990 | La See | |
| 4,989,381 | A | | 2/1991 | De Block et al. | |
| 4,996,814 | A | | 3/1991 | Guillemet | |
| 5,123,211 | A | | 6/1992 | Schlicht et al. | |
| 5,133,168 | A | | 7/1992 | Neilly et al. | |
| 5,249,403 | A | | 10/1993 | Neilly et al. | |
| 5,323,579 | A | | 6/1994 | Ruff | |
| 5,339,584 | A | | 8/1994 | Ohtake et al. | |
| 5,547,720 | A | | 8/1996 | Rittler | |
| 5,560,149 | A | | 10/1996 | Lafevre | |
| 5,577,355 | A | | 11/1996 | Leonelli | |
| 5,636,484 | A | | 6/1997 | DeBlock | |
| 5,644,874 | A | | 7/1997 | McKann | |
| 5,644,881 | A | | 7/1997 | Neilly | |
| 5,735,089 | A | | 4/1998 | Smith et al. | |
| 5,749,184 | A | | 5/1998 | McKann | |
| 5,765,325 | A | | 6/1998 | DeBlock | |
| 5,809,707 | A | | 9/1998 | Bargados et al. | |
| 5,894,706 | A | | 4/1999 | Herbst | |
| 6,131,345 | A | | 10/2000 | Pelusio | |
| 6,318,037 | B1 | * | 11/2001 | Hansen | 52/208 |
| 6,321,495 | B1 | | 11/2001 | Oami | |
| 6,546,682 | B1 | | 4/2003 | DeBlock et al. | |
| 6,564,517 | B1 | | 5/2003 | Hanssen | |
| 6,637,164 | B2 | | 10/2003 | Kondo et al. | |
| 6,715,245 | B2 | | 4/2004 | Lewkowitz | |
| 6,837,011 | B2 | | 1/2005 | Berger, Jr. | |
| 7,954,285 | B2 | * | 6/2011 | Taylor et al. | 52/208 |
| 2003/0221803 | A1 | | 12/2003 | Forsland | |
| 2004/0016189 | A1 | | 1/2004 | Berger | |

* cited by examiner

IMPACT WINDOW ASSEMBLY FOR OVERHEAD DOOR

BACKGROUND OF THE INVENTION

This invention relates to overhead doors, and more particularly, to impact resistant window assemblies installed in the overhead doors.

Garage or overhead doors typically include a number of hingedly connected panels that are moved from a vertical position to a horizontal overhead position over tracks. Window assemblies are typically positioned on the uppermost panels. They are designed to enhance the aesthetic appeal of the door while permitting daylight to pass through the door.

Because such doors present such a large surface area, usually to cover the single biggest opening on the house or building, the survival of such a door in a hurricane or storm is very important to the survival of the house. Experience has shown in older houses that when garage doors fail in hurricane winds a lot of additional damage follows. Older garage doors and new ones that are not properly constructed are highly susceptible to wind damage, including buckling, twisting off the tracks, total collapse, and failure due to impact from windborne debris. Commonly, garage door windows may be the portion of the door that is most susceptible to wind or storm damage.

When evaluating a door relative to such issues, there are two primary considerations. One is to be sure the door is rated for the correct wind pressure for the design wind speed of the area in which it is located. The other is to select a door that is also debris rated.

Efforts have been made for some years to improve the structural strength of elements of buildings, including the overhead garage doors, particularly in coastal areas and most particularly in the state of Florida after unexpectedly heavy damage was caused by recent hurricanes. Standards were developed for determining the merits of structures for withstanding damage in storms characterized by high winds, such as hurricanes and tornadoes. In such storms, strong winds entrain debris that may strike structures such as overhead garage doors and windows with considerable force.

An impact from fast moving debris can cause a structure such as a window or door to fail. Failure of a window or door potentially weakens the structure as a whole, and at least increases the likelihood of further damage by permitting wind, rain and possibly additional debris to enter the building. Conventional window glass is readily frangible (i.e., not tempered or laminated safety glass). Thus breaking the glass may leave an unobstructed opening.

The Florida Building Code (FBC-2010) requires houses in Miami-Dade or Broward Counties to be pressure and debris impact rated. Other areas of that state that are part of the windborne debris region defined in the Florida Building Code mandate that the garage door has to be pressure rated and the windows on the garage door have to be pressure and debris impact rated.

The specific standards applicable in South Florida and other jurisdictions are different in different counties, but typically divide a building into zones of different elevation. At low elevation up to 10 m of building elevation, relatively large wind-borne debris might be expected, such as trashcans, lawn furniture, tree limbs, fencing and building elements.

An exemplary standard for the "large missile zone," or low elevation zone, is found in the Florida Building Code TAS 201-94 Impact Test Procedures (2010) as well as Department of Energy (DOE) Standard 1020. This standard requires a door or window to survive test firing of a framing stud or a 2×4 lumber missile endwise at the test specimen, at a missile speed of 15 m/s (50 ft/sec or 35 mph). The criterion for a successful test under the FBC is that the test specimen rejects such a missile without any penetration. After the large missile impact tests, which may fracture the glass as discussed above, the test specimens are subjected to an extended series of many positive and negative wind pressure cycles. Similarly, ASTM Standard Specification E1996-12a and ANSI/DASMA 115 set forth a large missile level D in Table 2 of a 2×4 lumber at 50 feet/second. This is believed to have 350 ft-lb of energy for such an impact.

Door and window structures that can routinely survive such tests are available. Some are characterized by a transparent or translucent pane that is inherently strong enough to survive an impact and is mounted rigidly in a door, wall or other structurally sound panel via a rigid mounting structure that likewise can survive the impact. Other windows are laminates of materials and may have layers of glass and flexible plastic, metal or fibrous mesh reinforcement, etc.

The door light, glazing or window pane may be made very durable in and of itself, and/or the pane can be mounted in a manner intended to absorb impact stress. Even assuming the breakage of a frangible glass portion of the door light or window, the envelope that is defined by the window can be designed to remain intact. However, many such impact restraint overhead doors and associated windows are costly, unsightly, aesthetically unpleasing and difficult to install and/or assemble.

What is needed is an impact-resistant window structure for an overhead door, including the ability to survive impact, but also including unit cost, replacement cost, ease of installation, and attractiveness. The mounting for the window should provide a rigidly durable structural engagement for panes of glass or other glazing materials in the overhead door and also the resilient yet durable impact absorbing and resisting capabilities required by applicable building codes.

SUMMARY OF THE INVENTION

These and other objectives of this invention have been attained by various embodiments according to this invention. In one embodiment, the invention is a combination of first and second overhead door panels each adapted to be used in first and second overhead doors, respectively, and each being capable of selective movement between a generally horizontal open position and a generally vertical closed position covering first and second openings. A number of the first overhead door panels are serially connected together for pivotal movement relative to each other along a first track assembly mounted proximate the first opening. Likewise, a number of the second overhead door panels are serially connected together for pivotal movement relative to each other along a second track assembly mounted proximate the second opening.

Each of the first and second panels includes a window, but the first and second panels are of different thicknesses according to embodiments of this invention. For example, the first panel may be a fully insulated sandwich door panel construction with a layer of insulation positioned between front and back skins of the panel and the second panel may be a pan door construction with only a front skin.

The invention in various embodiments includes a pair of window frame sub-assemblies each substantially interchangeable with one another. Each window frame sub-assembly may include a front frame to be installed in either the first or second panel window opening. Glazing elements are mounted within each of the front frames and one or more fasteners secure the glazing element to the front frame. In various embodiments, the window frame sub-assemblies advantageously satisfy the Florida Building Code debris impact criteria.

First and second back frames may be juxtaposed to the first and second back face, respectively of the different overhead door panels, and coupled to one of the window frame sub-assemblies to thereby provide a window in the respective first or second overhead door panels. Advantageous features of this invention include the window frame sub-assemblies being interchangeable in a variety of overhead door panel designs irrespective of the thickness or construction of the door panel being a pan or fully insulated sandwich door construction. The glazing element is held entirely by the front frame without the need for a structural back frame. Impact resistance is provided by the window assembly without a structural back frame thereby reducing cost and simplifying stocking. Moreover, the window frame sub-assemblies provide these and other advantages in a robust and impact resistant design to satisfy local building code requirements for wind, hurricane and storm prone regions.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
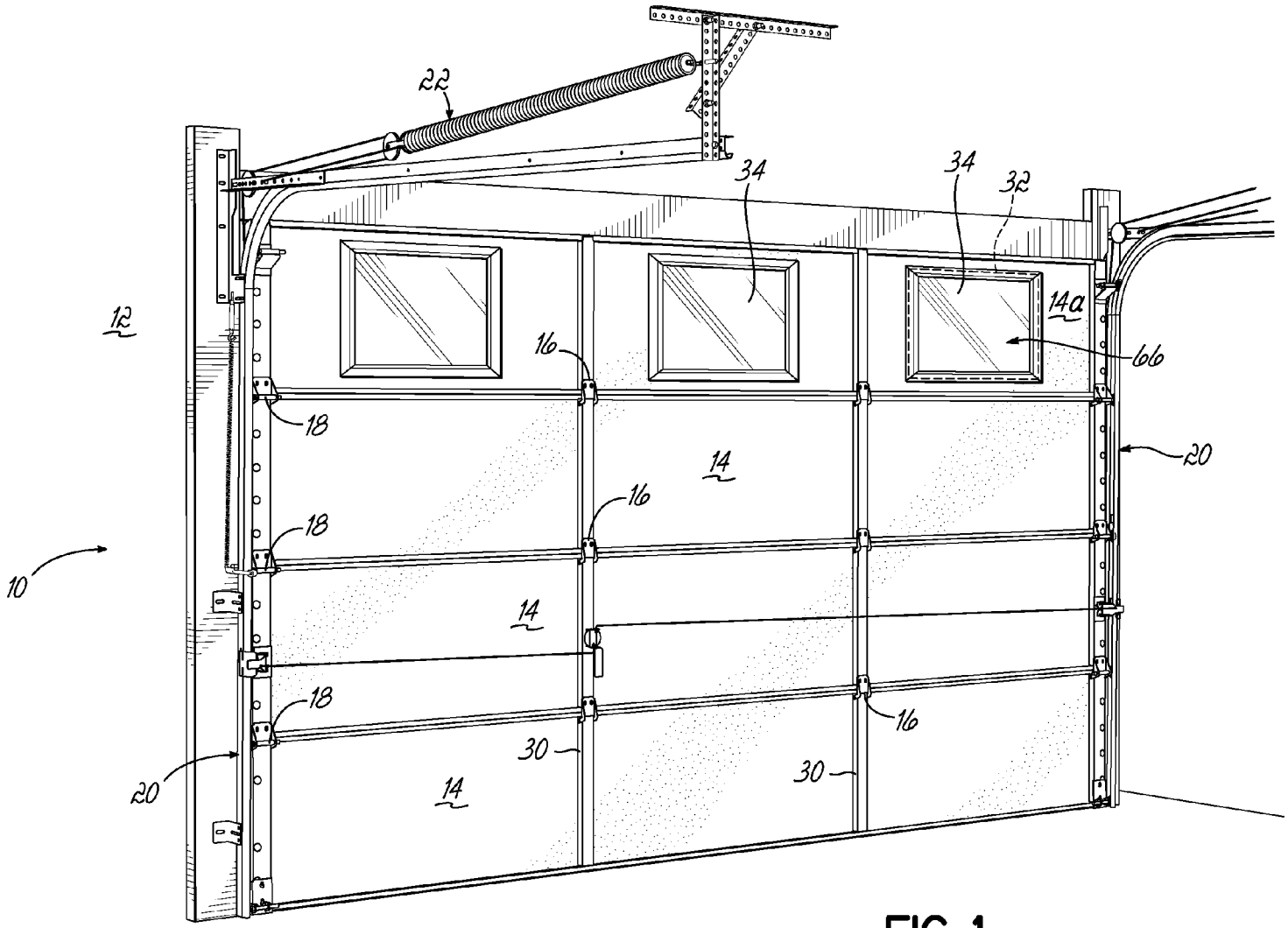
FIG. 1 is a perspective view of an exemplary overhead garage door installation in which various embodiments of an impact window according to this invention may be used.
Figure 2:
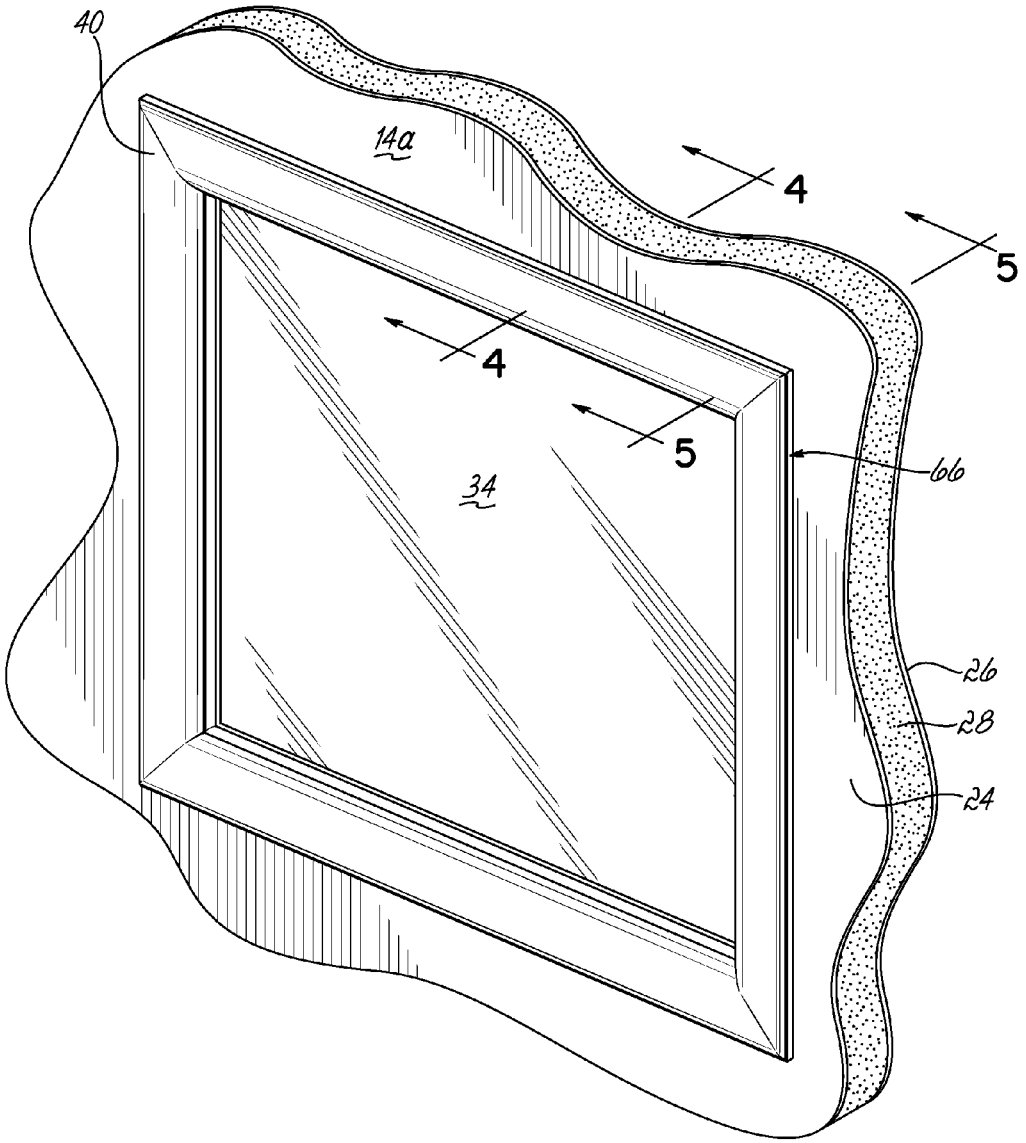
FIG. 2 is an enlarged exterior view of the impact window and surrounding an overhead, insulated door panel of sandwich type construction according to one embodiment of this invention.

Referring to FIG. 1, one embodiment of an overhead garage door 10 according to this invention is shown in a closed generally vertical configuration covering an opening in a wall 12 of a garage, warehouse or the like. The door 10 includes a number of panels 14. Each panel 14 includes upper and lower generally horizontally oriented edges which are configured to mate with the lower and upper edges, respectively, of an adjacent panel 14 when the door 10 is in the closed configuration as shown in FIG. 1.

The adjacent panels 14 are pivotally connected together by a number of hinge assemblies 16. The hinges 16 proximate the lateral side ends of each panel 14 include a roller assembly 18 for coupling the door 10 to a track assembly 20. The track assembly 20 guides the door 10 during movement to and between the open and closed positions. The opening and closing of the door 10 may be assisted by a counterbalance system 22 coupled to the door 10 as is well known in the art. The door construction shown and described herein thus far is exemplary only and a number of variations of such a door are well within the scope of this invention.

Referring particularly to FIGS. 1, 2 and 4-7, each panel 14 according to the various embodiments in this invention includes a front skin 24 defining a front face of the panel 14. Each panel 14 may include a back skin 26 defining, at least in part, a back face of the panel 14. Generally, each of the skins 24, 26 may be embossed sheet metal according to embodiments of the invention. Insulation 28 may be provided to fill the internal volume defined by the front and back skins, as is well known in the art. Alternatively, the insulation 28 may be mounted to the front skin 24 without a back skin. Moreover, other designs, styles and construction of panels are within the scope of this invention. Reinforcing stiles 30 may be included in or on each panel 14 for added strength.

One of the panels 14*a* includes window openings extending through the panel 14*a*. A window or glazing element 34 occupies each window opening to provide aesthetic appeal and to close off the opening 32. Each window glazing element 34 has a front face 34*a*, a back face 34*c* and an edge 34*b* joining the faces 34*a*, 34*c*. The glazing element 34 is mounted to the panel 14*a* by a front frame 36 that abuts the front skin 24 and extends around the perimeter of the associated window opening 32. A corresponding retainer 38*a*, 38*b* (FIGS. 4-7) may be provided on a rear face of the panel 14*a*. According to one embodiment, the window assembly may include a front façade 40 mounted to the front frame 36 for aesthetic reasons. The façade 40 may include a clip 42 to engage a lip 44 on the front frame 36 to selectively mount the façade 40 to the first frame 36. In one embodiment, the clip 42 extends longitudinally on each front frame member 36*a*, 36*b*, 36*c*, 36*d*, but does not extend the entire length of the front frame member and is centered on the longitudinal length thereof. Inner and outer seals 46, 48 may be included between associated edges of the façade 40 and the front skin 24 and the glazing 34, respectively. According to one embodiment, each front frame 36 includes opposed first and second side members 36*a*, 36*b* and opposed third and fourth side members 36*c*, 36*d*. Although the window openings 32, frame 36 and retainers 38*a*, 38*b* are each shown as having generally square or rectangular configurations, it will be appreciated that a wide variety of other configurations are possible as well. For example, in alternative embodiments the window openings, frames and retainers may have diamond, circular, oval or other shaped configurations.

Figure 3:
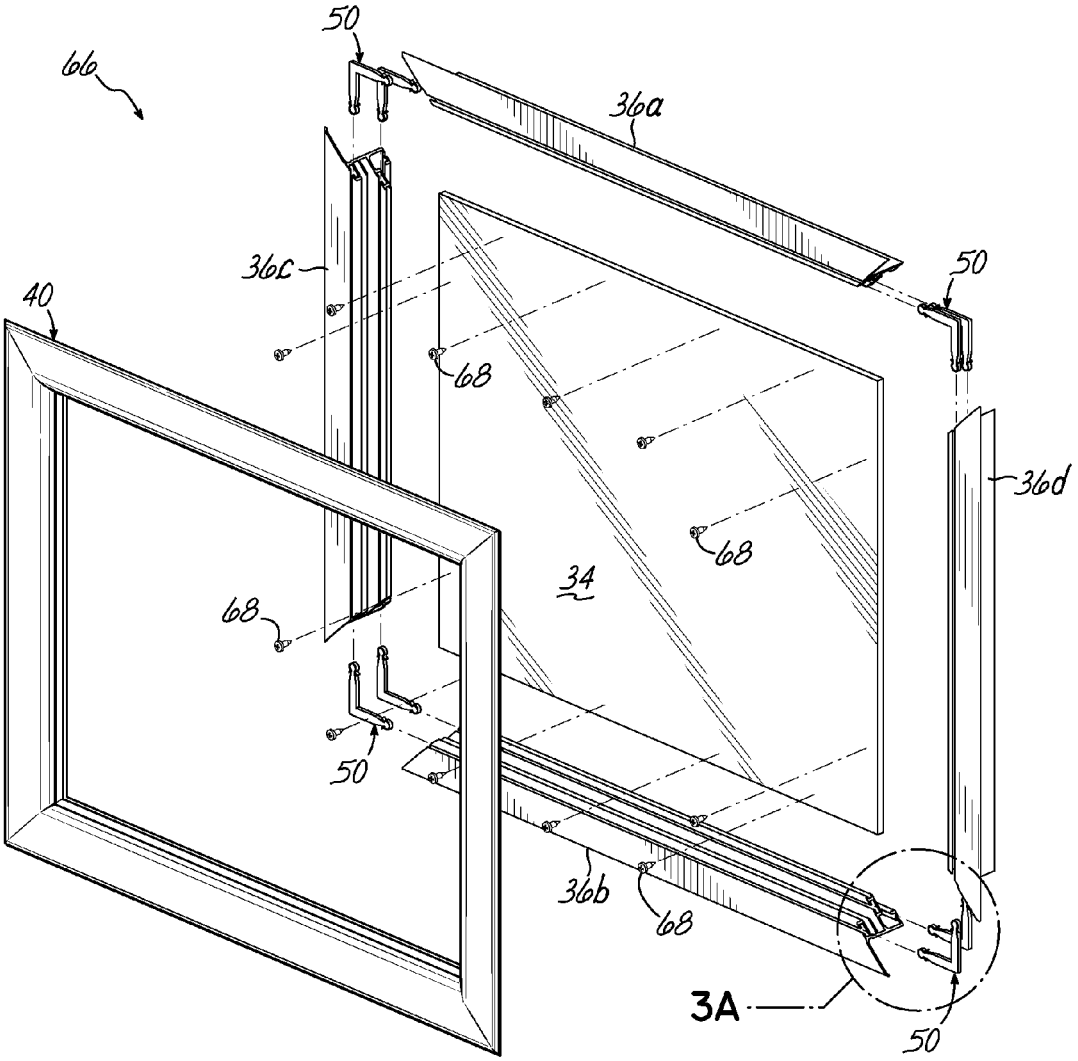
FIG. 3 is an exploded perspective view of a window frame sub-assembly according to one embodiment of this invention.
Figure 3A:
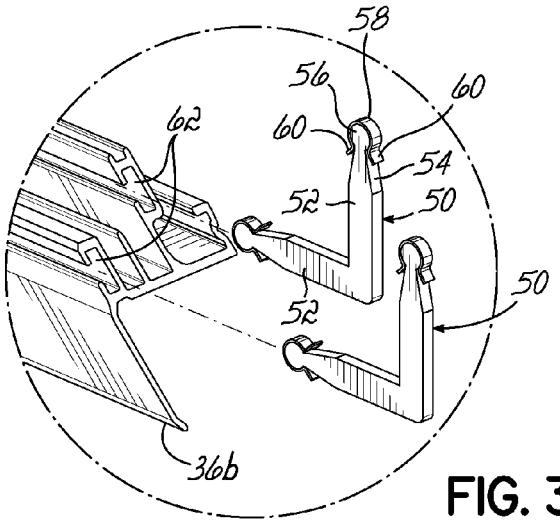
FIG. 3A is an enlarged view of area 3A in FIG. 3 of a corner connection of a portion of the window frame sub-assembly of FIG. 3.

In various embodiments of this invention, the front frame members 36*a*, 36*b*, 36*c*, 36*d* are assembled into a unitary front frame 36 with one or more corner connectors 50 as shown particularly in FIGS. 3-3A. Each corner connector 50 has a generally L-shaped configuration with a pair of legs 52 joined at generally perpendicular orientations. A terminal end of each leg 52 has a tapered narrow region 54 with a generally circular or rounded end section 56. Mounted on each rounded end section 56 is a steel spring or other material clip 58 with a pair of outwardly flared end prongs 60 on opposite sides of the corner connector 50. Each leg 52 of the corner connector 50 is inserted to an open-ended channel 62 formed in each front frame member 36*a*, 36*b*, 36*c*, 36*d* as shown particularly in FIG. 3A. In one embodiment, two corner connectors 50 are utilized to join two adjacent front frame members together and after the various front frame members are joined together, the glazing element 34 is encapsulated in the front frame 36 as shown particularly in FIG. 3.

Figure 4:
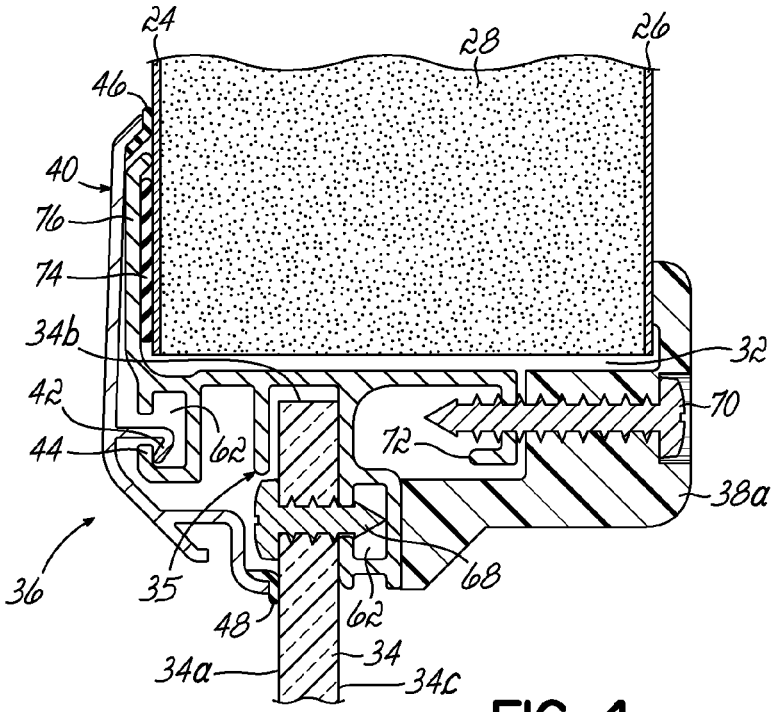
FIG. 4 is a cross-sectional view taken along line 4-4 of FIG. 2.
Figure 5:
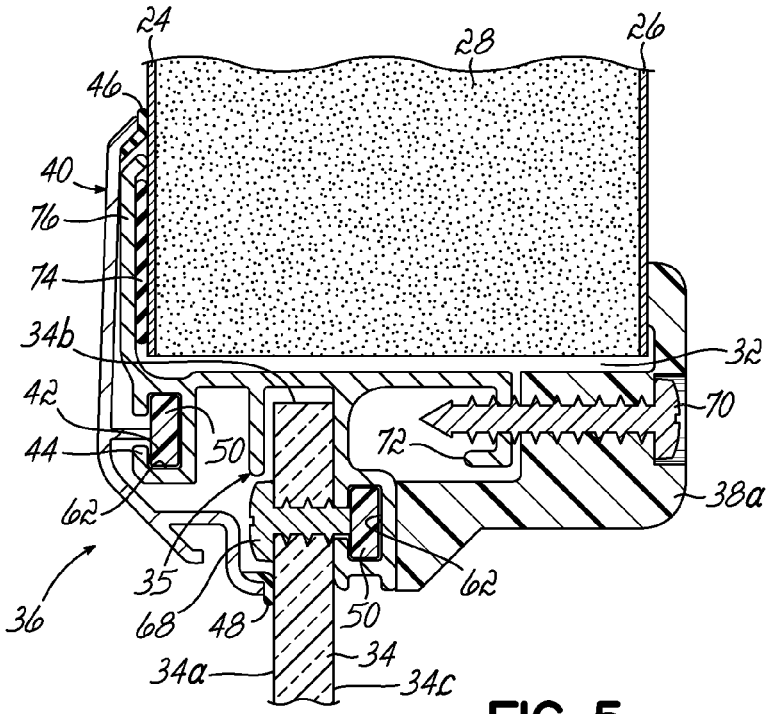
FIG. 5 is a cross-sectional view taken along line 5-5 of FIG. 2.
Figure 6:
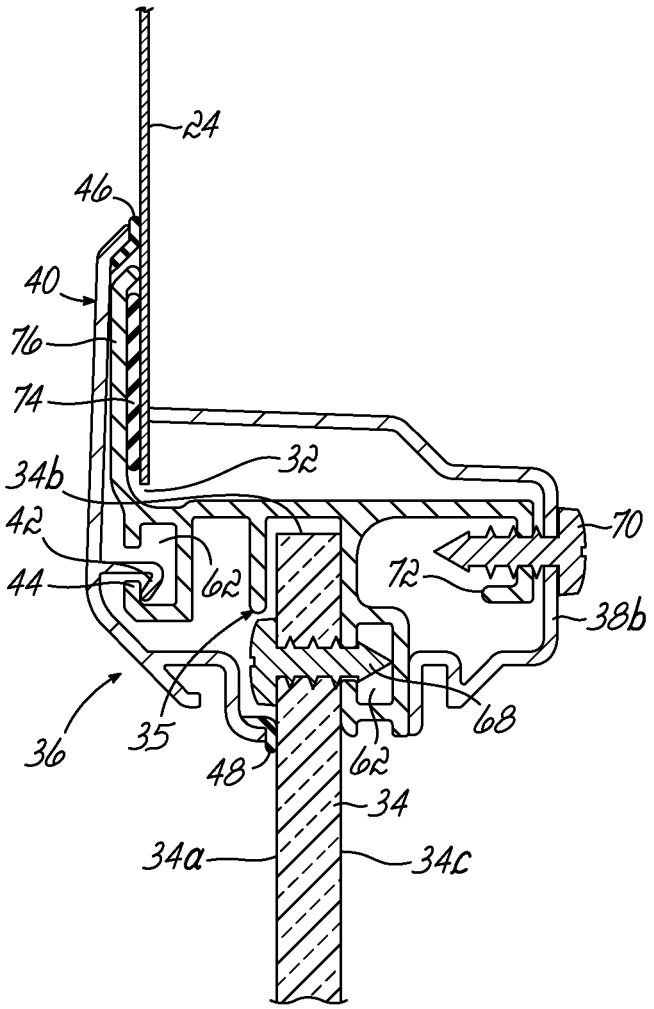
FIG. 6 is a cross-sectional view similar to FIG. 4 of the window frame sub-assembly of FIG. 3 assembled and installed in a pan door panel.
Figure 7:
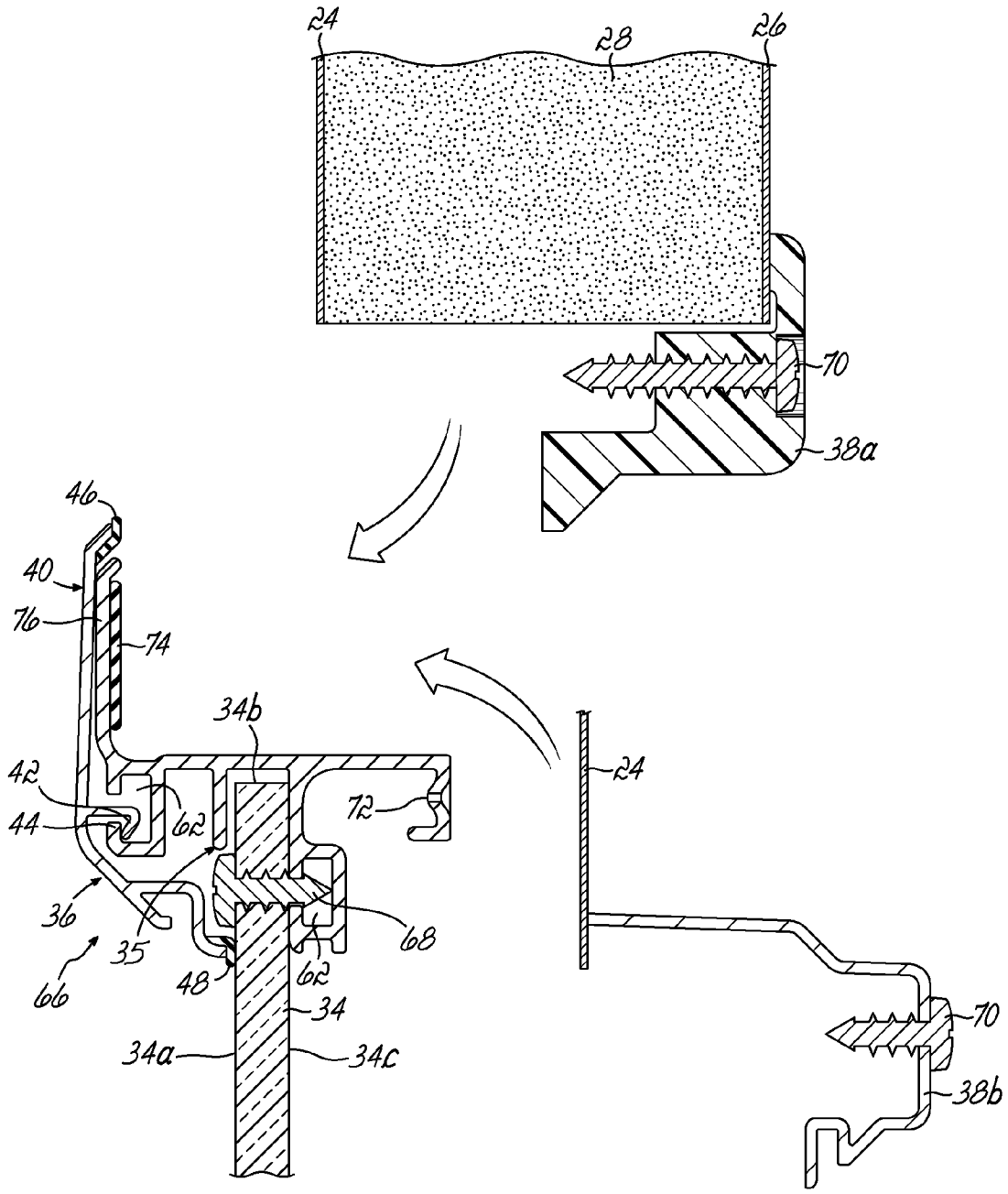
FIG. 7 is a view showing the window frame sub-assembly being mated with either an insulated door panel as in FIGS. 2, and 4-5 or a pane door panel as in FIG. 6.

Referring particularly to FIG. 3, one aspect of various embodiments of this invention is a window frame assembly 66. The window frame assembly 66 includes the front frame 36 assembled around the glazing element 34 and the glazing element 34 secured to the front frame 36 by a number of fasteners 68. The fasteners 68 project through the front frame members 36*a*, 36*b*, 36*c*, and 36*d* and into and through the glazing element 34 as shown more particularly in FIGS. 4-7. The window frame sub-assembly 66 may or may not include the façade 40 to be mounted to the front frame 36 according to various embodiments of this invention. Advantageously, the window frame assembly 66 and associated components are assembled together and adapted for insertion into any one of a variety of different overhead door panel 14 configurations, including a fully insulated sandwich-type board construction as shown in FIGS. 4, 5 and 7 a pan door construction shown in FIGS. 6-7 as well as other door panel configurations. The glazing element 34 is securely held and retained in the window frame assembly 66 without the benefit of additional components to be mounted on the back of the door panel 14, such as the retainers 38. In one aspect of this invention, the front frame 36 encapsulates the edge 34*b* and perimeter portions of the front and back faces 34*a*, 34*c* of the glazing element 34. The front frame includes a three-sided socket 35 to receive the edge 34*b* and perimeter portions of the front and back faces 34*a*, 34*c* of the glazing element as shown in FIGS. 4-7. Advantageously, the window frame assembly 66 may be inserted into a window opening 32 of appropriate size and configuration in any door panel construction design and an appropriate retainer 38 may then be mounted to the back face of the door panel 14 and window frame assembly 66 mounted in the window opening 32 thereof as shown in FIGS. 4-6. The ability for the window frame assembly 66 to be optionally installed in any one of a variety of door panel construction designs is demonstrated in FIG. 7. Once again, the glazing element 34 is securely held by the front frame 36 and appropriate fasteners 68 to form the window frame sub-assembly 66 without the benefit of the retainers 38. Once the window frame sub-assembly 66 is seated within the window opening 32 of an appropriately selected door panel 14, either one of a variety of retainers 38*a*, 38*b* may be secured to the back face of the door panel 14*a* proximate the window opening 32 and window frame sub-assembly 66. Fasteners 70 such as screws or the like are inserted through the retainer 38 and into a retaining lip 72 projecting rearwardly from the front frame 36 on the window frame sub-assembly 66.

A bead of adhesive 74 or the like may be inserted between the front skin 24 and an outwardly projecting lip 76 of the front frame 36 as shown particularly in FIGS. 4-7 to at least temporarily hold the window frame sub-assembly 66 in the window opening 32 until the retainer 38 and associated fasteners 7 are coupled thereto.

One additional advantage of the various embodiments of this invention is that the window frame sub-assembly 66 is sufficiently robust to provide impact resistance and pass the required building code tests for air-borne debris impacts. The window frame sub-assembly 66 meets and exceeds the FBC and other requirements, is aesthetically appealing and minimizes inventory and installation burdens associated with past designs.

From the above disclosure of the general principles of this invention and the preceding detailed description of at least one embodiment, those skilled in the art will readily comprehend the various modifications to which this invention is susceptible. Therefore, I desire to be limited only by the scope of the following claims and equivalents thereof.

I claim:

1. A method of constructing an overhead door comprising the steps of:

mounting a plurality of panels in a track for guiding the panels to and between open and closed positions relative to a door opening;

pivotally coupling each pair of adjacent panels together along a generally horizontal joints between each pair of adjacent panels;

assembling a window frame sub-assembly including a glazing element retained in a front frame surrounding the glazing element, wherein the glazing element includes a front face, a back face and an edge between the front and back faces, the assembling step further comprising encapsulating the edge and at least a perimeter portion of each of the front and back faces within the front frame;

wherein the assembling step further comprises (a) arranging a plurality of front frame members;

(b) joining the plurality of front frame members together;

(c) positioning the glazing element relative to the plurality of front frame members to thereby encapsulate the glazing element within the plurality of front frame members; and (d) securing the glazing element to the plurality of front frame members;

wherein the securing step further comprises, (1) inserting a plurality of fasteners into at least selected ones of the plurality of front frame members; and (2) engaging the glazing element with each of the plurality of fasteners;

inserting the window frame sub-assembly into a window opening in one of the plurality of panels;

juxtaposing the front frame of the window frame sub-assembly to a front face of the one of the plurality of panels surrounding the window opening; and attaching a retainer juxtaposed to a back face of the one of the plurality of panels to the wind frame sub-assembly;

wherein the glazing element is encapsulated in the window frame sub-assembly without the benefit of the retainer.

2. The method of claim 1 further comprising:

substantiating that the window frame sub-assembly is capable of withstanding about 350 ft-lb of impact energy without the benefit of the retainer.

3. The method of claim 1 wherein the securing step further comprises:

coupling a plurality of corner connectors to the plurality of front frame members, each front frame member having a terminal end juxtaposed to the terminal end of an adjacent front frame member and each corner connector being coupled to the respective terminal ends of the adjacent front frame members.

4. The method of claim 1 further comprising:

mounting a façade member to the front frame.

5. The method of claim 1 wherein the assembling step further comprises seating the edge and the perimeter portions of the front and back faces of the glazing element within a three-sided socket formed in the front frame.

6. An overhead door comprising:

at least one door panel mounted proximate a door opening for selective movement between an open position and a closed position covering the door opening;

a track assembly mounted proximate the door opening and coupled to the at least one door panel to guide the at least one door panel to and between the closed and open positions;

a window opening in the at least one door panel;

an impact resistant window frame sub-assembly comprising:

(a) a front frame installed in the window opening and juxtaposed to a front face of the at least one door panel;

(b) a glazing element mounted within the front frame, wherein the glazing element includes a front face, a back face and an edge between the front and back faces, wherein the edge and at least perimeter portions of each of the front and back faces are encapsulated within the front frame; and (c) a fastener securing the glazing element to the front frame;

wherein the fastener securing the glazing element to the front frame projects through the glazing element.

7. The overhead door of claim 6 further comprising:

a back skin on the at least one door panel.

8. The overhead door of claim 7 further comprising:

a layer of insulation interposed between the back skin and the front skin.

9. The overhead door of claim 6 further comprising:

a layer of insulation on the at least one door panel to define the back face.

10. The overhead door of claim 6 further comprising:

at least one retainer fastener joining the retainer to the window frame sub-assembly.

11. The overhead door of claim 6 further comprising:

a decorative façade element mounted to the front frame proximate the front face of the at least one door panel.

12. The overhead door of claim 6 further comprising:

a plurality of the door panels serially coupled together for pivotal movement relative to each other.

13. The overhead door of claim 6 wherein only one glazing element is mounted within the front frame.

14. The overhead door of claim 6 wherein the glazing element is held in the front frame without the benefit of the retainer.

15. The overhead door of claim 6 further comprising:

a retainer juxtaposed to a back face of the at least one door panel and coupled to the window frame sub-assembly;

wherein the window frame sub-assembly is secured to the at least one door panel and the glazing element is encapsulated in the front frame without the benefit of the retainer.

16. The overhead door of claim 6 further comprising:

a three-sided socket in the front frame receiving therein the edge and the perimeter portions of the front and back faces of the glazing element to thereby encapsulate the glazing element in the front frame.

* * * * *